United States Patent [19]

Ku

[11] Patent Number: 4,742,276

[45] Date of Patent: May 3, 1988

[54] REGULATED DEUTERIUM ARC SUPPLY SYSTEM

[75] Inventor: Yeegee Ku, Bloomingdale, Ill.

[73] Assignee: The Perkin-Elmer Corporation, Norwalk, Conn.

[21] Appl. No.: 889,536

[22] Filed: Jul. 25, 1986

[51] Int. Cl.[4] ..... H05B 41/36

[52] U.S. Cl. ..... 315/106; 315/94; 315/308; 315/175; 315/224; 315/205

[58] Field of Search ..... 315/224, DIG. 5, DIG. 7, 315/101, 107, 175, 205, 102, 103, 291, 307, 308, 94

[56] References Cited

U.S. PATENT DOCUMENTS 3,819,981 6/1974 Diamond ..... 315/107 X
4,158,793 6/1979 Lewis ..... 315/101
4,221,994 9/1980 Friedman et al. ..... 315/224
4,417,180 11/1983 Chamran et al. ..... 315/175
4,559,478 12/1985 Fuller et al. ..... 315/224

*Primary Examiner*—David K. Moore
*Assistant Examiner*—Mark R. Powell
*Attorney, Agent, or Firm*—Ronald G. Cummings; Francis L. Masselle; Edwin T. Grimes

[57] ABSTRACT

An improved power supply system of smaller size and lower cost than prior art supplies is described for starting and maintaining the running of a deuterium arc lamp at a constant current level; by use of switching circuitry with solid-state components the necessity of transformers, relays and timing circuits has been obviated with a resultant major reduction in size, cost and cooling requirements of the supply; an improved starting sequence lengthens lamp cathode life.

15 Claims, 2 Drawing Sheets

REGULATED DEUTERIUM ARC SUPPLY SYSTEM

FIELD OF INVENTION

This invention relates to spectrophotometers and, more specifically, to a specialized low cost power supply system for starting, running and controlling a deuterium arc lamp ($D_2$ lamp) commonly used as a UV source for a spectrophotometer.

BACKGROUND OF THE INVENTION

The use of the now well-known hot cathode deuterium arc lamp ($D_2$ lamp) as a near UV source for a spectrophotometer is common. This lamp requires four hundred volts or more for the arc to strike, yet when running the arc current must be kept very constant, typically at 300 mA, with an arc voltage drop of about 70 to 90 V. In addition, to strike the arc, additional power, for instance 1 A. at 10 V., must be supplied to the cathode heater to raise the cathode temperature enough to establish an adequate arc plasma. The arc, once struck, will keep the cathode hot, hence, this external power should then be switched off to prevent the cathode from overheating.

All these operating power requirements have in the past been supplied by special power supplies. A typical supply might be built up of a high voltage supply, a running voltage supply, a low voltage high current supply and various relays, timers and regulating circuits to control these supplies in the proper sequence and manner. Conventionally, the regulating circuit for anode current has been of the analog type, utilizing a series pass transistor for control. Such a circuit normally has low efficiency because of the resistance loss in the series control transistor. This loss appears as heat which must be dissipated in a heat sink of substantial size requiring good ventilation, an arrangement necessitating a fairly bulky supply structure. The size, cost and losses of these combinations places high demands on the equipment group for the spectrophotometer.

The development of a new, low cost, photodiode array spectrophotometer set up a demand for a drastically smaller, higher efficiency regulated power supply for the $D_2$ lamp source.

One of the prior problems was associated with the traditional requirement of heating the $D_2$ lamp cathode before applying the high starting voltage to the anode. This was usually effected by using a timing circuit or relay for switching on power to the cathode heater so that the cathode reaches a red heat before the starting voltage is applied. The philosophy of this prior art has been, that applying starting voltage to an unheated cathode would shorten the lamp life by erosion of the cathode emitting layer. In most cases timing circuits or relays also were used to switch off the heater current after the lamp was running, since the arc drop was capable of keeping the cathode hot. Such timing device were costly and bulky.

Unexpectedly, we have found the prior art concept of preheating the cathode to be not only unnecessary but also inadvisable. It can be shown that applying starter voltage to a cold cathode before the lamp has started will not damage the cathode since no current is flowing. Research at M.I.T., resulting in the invention of the dispenser cathode by E. A. Coomes, showed that deterioration of the cathode emitting material is due primarily to heavy arc current. If the cathode is heated without arc current flowing, the arc will strike when the temperature reaches a value high enough to supply sufficient ions for the arc, and no deterioration of the cathode will result. Once the arc strikes the heater current can be switched off to prevent the cathode from being overheated. According to the present invention, this starting sequence is effected through solid state sensor and switching means without timers or relays, thus reducing sharply both the cost and the size of the circuitry.

The present application is directed to a novel switching type power supply, which successfully accomplishes the objectives set forth.

It is an object of this invention to provide power supply. means driven by a low dc voltage input.

It is a further object that said supply means generate a low current, high voltage output adequate to start a $D_2$ lamp when its cathode is hot.

It is a further object that said supply means also generate a closely regulated medium current output of proper value to run said $D_2$ lamp.

It is yet a further object that said supply means deliver a high current, low voltage to heat the cathode of said $D_2$ lamp subsequent to the application of the starting voltage, this heater current being terminated when the lamp has started and reached self-heating stability.

It is also an objective that all components of this supply means be solid state and multi-functional insofar as practical to minimize number, size and cost.

It is also an objective that this supply means be switchable on or off by a TTL or equivalent command.

It is also an objective that all components be mountable on a single small printed circuit board.

Other objects and advantages will become apparent from the following detailed description and accompanying drawings.

BRIEF DESCRIPTION OF THE INVENTION

The basic high voltage generator of the power supply means of this invention comprises a low loss inductor connected in series with a switching transistor. When the transistor switch is closed, i.e. low resistance, current flows through the inductor from a low voltage dc supply to ground, setting up a magnetic field near saturation in the inductor core. When the transistor switch opens the magnetic field collapses inducing a high voltage across the inductor winding. This voltage also appears across the open switch and may be passed through a diode to charge a storage capacitor to many times the supply voltage. Such a system is used to provide the running voltage for the $D_2$ lamp.

To provide the lamp starting voltage, about four times greater, a cascade diode-capacitor multiplier is also fed from the basic generator.

The periodic switching of the basic generator in the preferred embodiment is driven by the pulse output of a Regulating Pulse Width Modulator (PWM). This solid state monolithic integrated circuit furnishes rectangular single polarity pulses at a constant frequency to the base of the switching transistor. The pulse width or duty factor can be varied from essentially zero to about 90% of the pulse period by varying the voltage on a control pin of the PWM. This makes it possible to control the power supply output by feedback from a current sensing circuit in the $D_2$ lamp anode lead. Likewise protective voltage limiting during the starting time or in case of lamp extinction can be similarly provided. The sensing circuit, working through a coacting auxiliary switching circuit, also provides means to control the external cathode heating current during the lamp start period and to remove this current during run operation of the lamp.

Both the starting voltage supply and the running voltage supply build up together rapidly when a TTL ON command is applied to energize the PWM output circuit. This TTL command also switches on heating current to the $D_2$ lamp cathode. Because of the protective voltage limiting circuit the starting voltage will not be able to strike the arc in the lamp until the cathode comes up to adequate ionizing temperature. The small energy storage capacity of the capacitors in the starting multiplier circuit prevents local damage to the cathode surface during arc strike by keeping the starting energy transient low as the voltage plunges from starting voltage to running voltage level. The running voltage, being feedback controlled, automatically adjusts at once to set the proper arc current and maintain it. Any initial large surge in the anode current is thus minimized. The low starting energy transient also minimizes the possibility of introducing stray pickup spikes into the digital measurement and command circuits of the spectrophotometer. Elaborate transient filters in the supply leads are thus made unnecessary. This novel combination of a voltage limited, low energy capacity starting supply and a feedback controlled running supply has been demonstrated to provide the above features without the use of prior art preheating circuits for the cathode and their associated timing devices and relays.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis of the defining of other assemblies and routines for carrying out the various purposes of the invention. It is important, therefore, that this disclosure be regarded as including such equivalent assemblies and routines as do not depart from the spirit and scope of the invention.

One embodiment of the invention has been chosen for purposes of illustration and description, and is shown in the accompanying drawings forming a part of the specification.

DETAILED DESCRIPTION OF A PRESENTLY PREFERRED EMBODIMENT OF THE INVENTION

Figure 1:
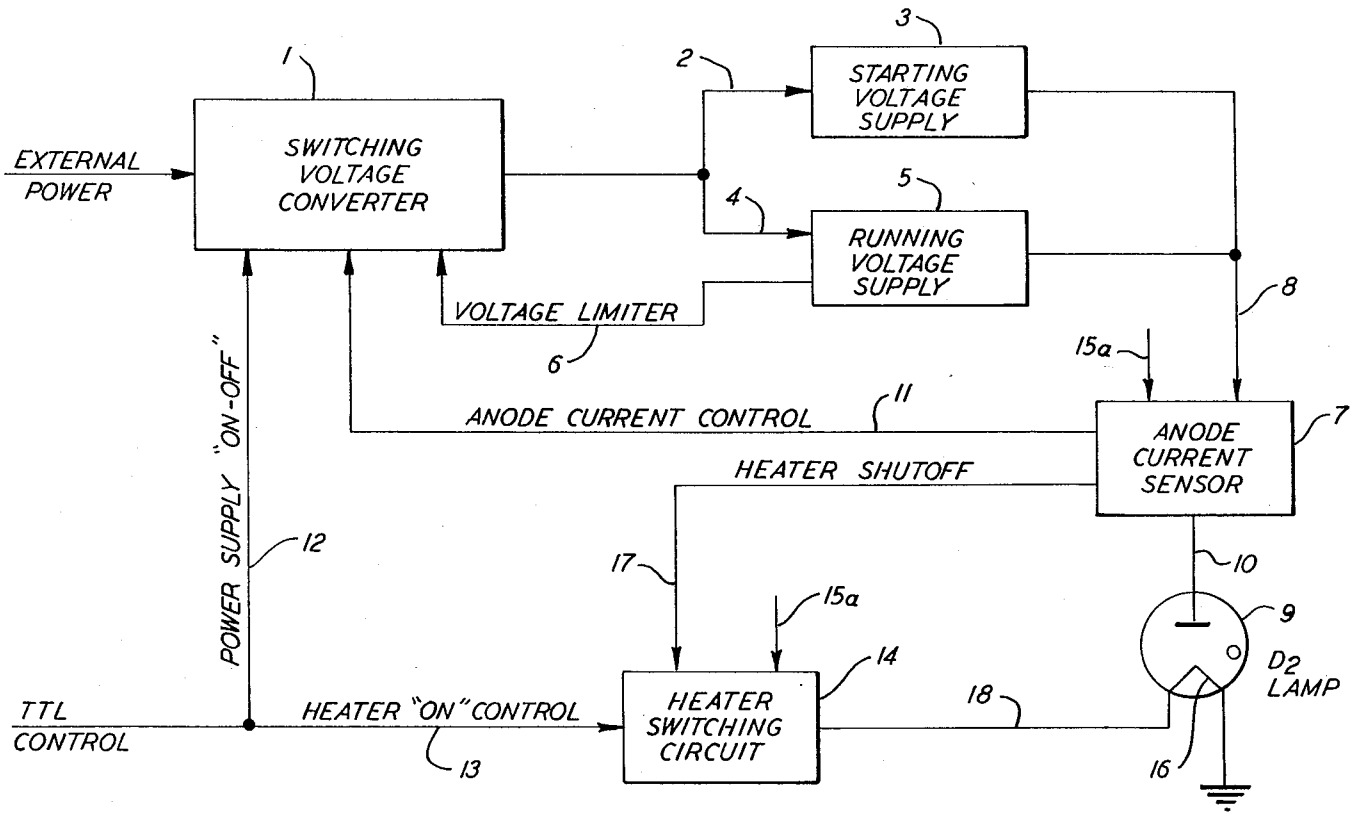
FIG. 1, is a block diagram of the preferred embodiment of the invention.

FIG. 1 is a block diagram of the invention wherein an externally derived power input of 24 Vdc is supplied to a variable output switching voltage converter 1. The switching converter delivers an output voltage in the form of periodic pulses having a maximum noload peak voltage limited to 120 V. These pulses have a period, which may conveniently be 50 μsec. The output voltage is delivered to two power supplies through conductors 2 and 4. The starting supply is a voltage multiplier storage circuit 3 for developing a noload peak voltage of 480 Vdc for starting the arc in the $D_2$ lamp. The running current supply is a high energy capacity rectifier storage circuit 5 for supplying anode arc current to the lamp. Supply 5 is provided with a secondary output circuit which returns a signal through conductor 6 to converter 1. This circuit limits the noload output voltage of the converter to the maximum peak voltage of 120 V cited above to prevent overvoltaging of the lamp or premature arcing in the lamp. The outputs of supplies 3 and 5 are both connected to a current sensor circuit 7 by conductor 8. The anode current of the $D_2$ lamp 9 passes through this current sensor and is delivered to the $D_2$ lamp, which is in the optical system of the spectrophotometer, by conductor 10. When the $D_2$ lamp is operating in its normal running condition its anode current is 300 mA. Should the anode current vary from this normal value a conductor 11 returns a feedback signal to the converter which restores the anode current to its normal value by means to be clarified hereinafter.

Starting and running of the $D_2$ lamp proceeds automatically when a TTL command signal goes plus through conductor 12 which connects to converter 1. This same command is also conveyed through conductor 13 to a heater switching circuit 14. When the TTL signal goes plus, current from a secondary external 12 Vdc power source 15 provides heat to the cathode 16 of the $D_2$ lamp through conductor 18. The lamp starts when the cathode temperature rises to about red heat. Establishment of anode current through the $D_2$ lamp sends a voltage command through conductor 17 to the heater switching circuit, resulting in switching off the cathode heating current to prevent overheating.

Should the lamp power be interrupted momentarily, restoration will cause the starting cycle to repeat automatically.

Figure 2:
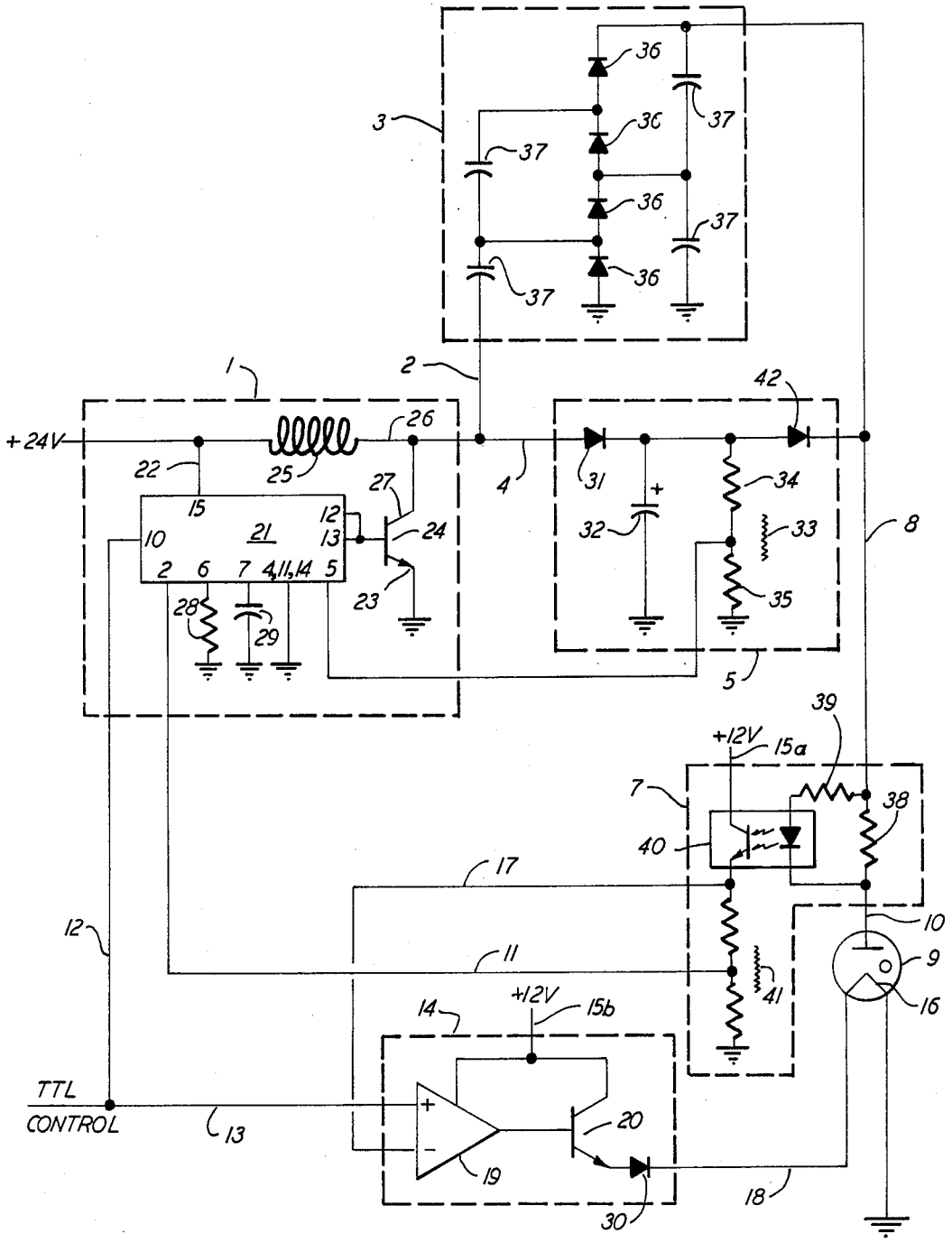
FIG. 2, is a wiring schematic representation of the preferred embodiment of the invention.

Referring now to FIG. 2, the switching voltage converter includes a regulating pulse width modulator 21 supplied with 24 Vdc power from an external power source. The pulse width modulator (PWM) of the preferred embodiment may be a commercial type such as, for example, an LM3524 made by National Semiconductor, Inc , or an equivalent thereof Significant commercial pin connection numbers for the PWM are shown in FIG. 2. For example, the 24 Vdc input power is connected by conductor 22 to pin 15. In addition the 24 Vdc input power is connected to an inductor 25. The other end 26 of the winding of this inductor is connected to the collector 27 of a switching transistor 24, the emitter 23 of which is grounded. This transistor may be, for example, an RFP8 (N20L) NPN type or an appropriate equivalent. The base of transistor 24 is connected to pins 12 and 13 of the PWM which are the pulse output terminals. The output pulses are alternate, rectangular +5 V pulses having a period of about 50 microseconds as set by an oscillator in the PWM and by a 2K resistor 28 and a 0.025 μF capacitor 29 connected to pins 6 and 7, respectively. The output pulses have a variable pulse width controllable, as will be discussed later, from 0 to 90% of the period. These pulses may also be turned on or off by a voltage signal applied to pin 10 of the PWM.

When the base of transistor 24 is driven to +5 V by a pulse, the transistor will become "ON", i.e., it switches the end 26 of the inductor 25 to within a volt of ground potential. The current through the inductor will rapidly rise to a maximum high value limited only by the circuit and source resistances. A typical inductor comprises a ferrite ring core wound as a toroid with about 100 turns of wire which may be No. 18 B&S gage. Such an inductor may have an inductance of nominally 500 mH. The specific requirement is that the magnetic field of this inductor shall collapse within about 2.5 microseconds when the pulse voltage drops to ground (zero volts) level on the base of the transistor, thus generating an inductive voltage peak of 120 V or more across the inductor winding. This voltage pulse is used to charge the capacitors in the starting and running voltage sections of the power supply.

The running voltage supply 5 comprises a fast recovery diode 31 such as, for example, a MUR840 or equivalent which passes the inductive energy pulse to a 580 μF storage capacitor 32. The charge-up time of this capacitor when the PWM 21 is first turned on by a +5 V TTL signal applied to pin 10 is about 20 to 50 msec. depending on the characteristics of the inductor 25. The charge-up voltage is prevented from exceeding 120 V, noload, by a limiter circuit comprising a voltage divider 33 having a 10 K resistor 34 in series with a 20 ohm resistor 35. The junction point of this divider is tied to pin 5 of the PWM by conductor 6 at which pin a plus voltage of about 200 mV will reduce the output pulse width of the PWM to substantially zero, thus shutting off the charging of capacitor 32. The reason for this limiter will be clarified presently.

The starting voltage supply 3 comprises, for example, a conventional four stage multiplier including four 1N4004 diodes 36 and four 0.04 μF/1 kV capacitors 37. Diode 42 (1N4004) blocks the starting voltage from the running voltage supply section 5. The starting circuit is supplied with the same inductive energy pulses as the running voltage supply through conductor 2, and hence must take the same charge-up time although the stored energy at voltage limiting is a couple of orders of magnitude less. Small capacitors are used in the starting circuit to minimize possible erosion of the lamp cathode coating 16 by the current surge when the arc strikes. As pointed out above, the lamp strikes when its cathode reaches approximately a red heat, a condition caused by a cathode heater which is supplied with power through the conductor 18 from the switching circut 14. An op-amp 19 causes the base of switching transistor 20 to go plus when the TTL ON command is received through conductor 13. The op-amp 19 may be an LM358; the transistor 20 may be an RFP8 or equivalent. Diode 30 (1N4004) protects the switching circuit from heater voltage kick-back during striking surges. Cathode temperature rise takes approximately a second or two; once the lamp strikes the anode current will maintain adequate cathode temperature by ion bombardment. At striking, the anode voltage of the lamp drops rapidly from 480 V to about 70 to 90 V, the running voltage at the normal anode current of 300 mA. During this anode voltage decay, the anode current is momentarily above normal, a condition which would degenerate the cathode coating, as has been previously stated, unless the striking pulse is kept short. Hence, small capacitors are used in the starting supply to minimize starting pulse length.

Control of the anode current and of the cathode heater current is provided by the anode current sensor 7. The drop in the 5.5 ohm resistor 38 supplies current through the 22 ohm resistor 39 to the LED of an optoelectronic coupler 40 which may be a H11B1 or equivalent. The current flow through the phototransistor of the coupler causes a voltage drop across a resistance divider 41. Conductor 17 goes plus shutting off the cathode heater current through action of the heater. switching circuit 14. A variable voltage, controlled by anode current value, is supplied from divider 41 through conductor 11 to pin 2 of the PWM. The variable voltage effects a feedback control by altering the output pulse width of the PWM. An increase of pulse width, for example, increases the charging rate of capacitor 32, thus increasing the voltage supplied to the anode of the $D_2$ lamp through the conductor 8, hence in this case the lamp current would rise. Decrease of the pulse width on the contrary would reduce lamp running voltage and current. Thus, this feedback stabilizes and maintains the anode current accurately at its nominal value.

Although a certain particular embodiment of the invention has been disclosed herein for purposes of explanation, various modifications thereof, after study of the specification, will be apparent to those skilled in the art to which the invention pertains, and reference should accordingly be had to the appended claims in determining the scope of the invention.

What is claimed is:

1. A power supply system for a deuterium arc lamp comprising, in combination:

a variable output switching voltage converter for generating a pulsed output voltage when energized from an external voltage source;

a voltage multiplier storage circuit driven from said output voltage for supplying starting voltage to the arc in said deuterium lamp;

a rectifier storage circuit driven from said output voltage for supplying running anode arc current to said lamp;

current sensor means coacting with said voltage converter for continuous feedback control of said output voltage in response to anode current level of said deuterium arc lamp; and switching means for applying cathode heater current to said arc lamp coincidentally with the energization of said voltage converter from said external voltage source.

2. The system of claim 1 wherein said voltage converter comprises a regulating pulse width modulator.

3. The system of claim 2 wherein said voltage converter comprises an inductor switched by a transistor, said transistor being controlled by the output voltage pulses of said pulse width modulator.

4. The system of claim 1 wherein the output pulse width of said pulse width modulator is controlled by a feedback signal from said current sensor means so as to maintain a constant anode current level.

5. The system of claim 1 wherein the voltage from said voltage multiplier storage circuit is applied to the deuterium lamp anode before the cathode temperature of said lamp rises to a value at which said lamp can strike.

6. The system of claim 1 wherein said voltage converter comprises a regulating pulse width modulator means for providing output pulses to control a switching transistor, a switching transistor and an inductor switched by said transistor for generating a constant frequency varible pulse width output voltage.

7. The system of claim 6 wherein said inductor comprises a single coil wound on a toroidal ferromagnetic core.

8. The system of claim 6 wherein said modulator means comprises a single monolithic integrated circuit.

9. The system of claim 1 wherein said voltage multiplier storage circuit comrises a cascade diode-capacitor multiplier circuit having a plurality of capacitors with small energy storage capacity for generating only a low starting energy transient in striking an arc.

10. The system of claim 9 wherein said rectifier storage circuit comprises high energy storage capacitor means and circuit means for limiting the charge-up voltage of said capacitor means.

11. The system of claim 10 wherein said rectifier storage circuit and said voltage multiplier storage circuit are connected to said voltage converter for simultaneous charging by said voltage converter.

12. A power supply system for a deuterium arc lamp comprising, in combination:

a variable output switching voltage converter for generating a pulsed output voltage when energized from an external voltage source;

a voltage multiplier storage circuit driven from said output voltage for supplying starting voltage to the arc in said deuterium lamp;

a rectifier storage circuit driven from said output voltage for supplying running anode arc current to said lamp;

current sensor means coacting with said voltage converter for continuous feedback control of said output voltage in response to anode current level of said deuterium arc lamp; and switching means for applying cathode heater current to said arc lamp coincidentally with the energization of said voltage source and coacting with said sensor means to terminate flow of cathode heater curent when said anode current attains substantially normal value.

13. A method of starting and operating a deuterium arc lamp of the type having an anode, cathode and cathode heater means in an analytical instrument comprising:

applying a starting voltage to the arc lamp, providing cathode heater current to bring the cathode to arcing heat no earlier than the application of starting voltage so as to start the lamp, and providing running anode arc current to said lamp upon starting and terminating cathode heater current.

14. The method of claim 13 which comprises sensing anode current and terminating cathode heater current responsive to sensing running anode current.

15. The method of claim 13 wherein applying a starting voltage comprises applying a low energy starting voltage sufficient to strike an arc when the cathode is hot while generating only a low starting energy transient.

* * * * *

UNITED STATES PATENT AND TRADEMARK OFFICE

CERTIFICATE OF CORRECTION

PATENT NO. : 4,742,276

DATED : May 3, 1988

INVENTOR(S) : Yeegee Ku

It is certified that error appears in the above-identified patent and that said Letters Patent are hereby corrected as shown below:

Column 6, line 2, after "heater" delete ".".

Column 6, line 43, after "Claim 1" insert --or 12--.

Column 6, line 49, after "Claim 1" insert --or 12--.

Column 6, line 53, after "Claim 1" insert --or 12--.

Column 6. line 58, after "Claim 1" insert --or 12--.

Column 7, line 1, after "Claim 1" insert --or 12--.

Signed and Sealed this

Twenty-eighth Day of February, 1989

*Attest:*

DONALD J. QUIGG

*Attesting Officer*

*Commissioner of Patents and Trademarks*